US011009253B2

(12) United States Patent
Berkompas et al.

(10) Patent No.: US 11,009,253 B2
(45) Date of Patent: May 18, 2021

(54) VENT STRUCTURE

(71) Applicants: Brent Berkompas, San Clemente, CA (US); Kelly Berkompas, San Clemente, CA (US)

(72) Inventors: Brent Berkompas, San Clemente, CA (US); Kelly Berkompas, San Clemente, CA (US)

(73) Assignee: Brandguard Vents, San Clemente, CA (US)

( * ) Notice: Subject to any disclaimer, the term of this patent is extended or adjusted under 35 U.S.C. 154(b) by 815 days.

(21) Appl. No.: 15/659,567

(22) Filed: Jul. 25, 2017

(65) Prior Publication Data

US 2018/0023841 A1 Jan. 25, 2018

Related U.S. Application Data

(60) Provisional application No. 62/366,520, filed on Jul. 25, 2016.

(51) Int. Cl.

| | |
|---|---|
| ***F24F 11/00*** | (2018.01) |
| ***F24F 13/08*** | (2006.01) |
| ***F24F 7/04*** | (2006.01) |
| ***F24F 11/76*** | (2018.01) |

(Continued)

(52) U.S. Cl.

CPC ..... *F24F 11/76* (2018.01); *A62C 2/065* (2013.01); *F24F 7/04* (2013.01); *F24F 11/35* (2018.01); *F24F 11/0001* (2013.01); *F24F 13/082* (2013.01)

(58) Field of Classification Search

CPC .. F24F 11/33; F24F 11/35; F24F 11/76; F24F 11/0001; F24F 13/082; F24F 7/04; A62C 2/065

See application file for complete search history.

(56) References Cited

U.S. PATENT DOCUMENTS 925,144 A * 6/1909 Ward ..... E06B 7/02 454/224
1,673,906 A 6/1928 Fager (Continued)

FOREIGN PATENT DOCUMENTS

CA 2444106 A1 * 4/2004 ..... F24F 7/065
DE 102004047093 A1 * 6/2006 ..... F16L 55/1018

(Continued)

OTHER PUBLICATIONS

International Search Report International application No. PCT/US07/24242 dated Jul. 18, 2008 (Jul. 18, 2008).

*Primary Examiner* — Kenneth J Hansen
*Assistant Examiner* — Phillip Decker
(74) *Attorney, Agent, or Firm* — Fish IP Law, LLP

(57) ABSTRACT

A vent apparatus that prevents the ingress of flames, superheated air, and/or flaming materials (e.g., embers) from an external fire to a building or structure is disclosed. The vent apparatus comprises a frame that defines an inlet, and outlet, and an internal passage. A guiding member is disposed within the internal passage to thereby deflect or direct a portion of a flow of material between the inlet and outlet. A blocking element is disposed on the guiding member that is configured to expand to at least partially block the flow of material between the inlet and outlet.

18 Claims, 6 Drawing Sheets

(51) Int. Cl.
*F24F 11/35* (2018.01)
*A62C 2/06* (2006.01)

(56) References Cited

U.S. PATENT DOCUMENTS

| | | | | | |
|---|---|---|---|---|---|
| 1,995,456 | A * | 3/1935 | Kannel | F24F 13/08 | 454/224 |
| 4,194,521 | A * | 3/1980 | Banta | A62C 2/065 | 137/67 |
| 4,493,173 | A * | 1/1985 | Kohaut | F16L 5/04 | 174/482 |
| 4,715,268 | A * | 12/1987 | Tanner | F24F 13/1426 | 454/256 |
| 5,058,341 | A * | 10/1991 | Harbeke, Jr. | F16L 5/04 | 52/232 |
| 5,103,609 | A * | 4/1992 | Thoreson | A62C 2/065 | 52/232 |
| 5,467,565 | A * | 11/1995 | Bowman | E04B 5/48 | 174/482 |
| 5,542,224 | A * | 8/1996 | Olsen | F24F 13/08 | 52/473 |
| 5,957,211 | A * | 9/1999 | Geuken | A62C 2/065 | 169/48 |
| 6,305,133 | B1 * | 10/2001 | Cornwall | F16L 5/04 | 52/1 |
| 6,679,015 | B1 * | 1/2004 | Cornwall | A62C 2/065 | 52/1 |
| 6,752,714 | B1 * | 6/2004 | Mann | A62C 2/065 | 454/257 |
| 7,413,024 | B1 * | 8/2008 | Simontacchi | A62C 2/065 | 169/48 |
| 8,087,205 | B2 * | 1/2012 | Pilz | E04B 1/948 | 52/232 |
| 8,464,485 | B2 * | 6/2013 | Hilburn | E04B 1/948 | 52/317 |
| 8,517,809 | B2 * | 8/2013 | Wexler | E06B 7/08 | 454/277 |
| 8,684,803 | B2 | 4/2014 | Berkompas | | |
| 9,901,760 | B2 * | 2/2018 | Erb | A62C 2/065 | |
| 9,945,127 | B2 * | 4/2018 | Edwards | E04D 1/24 | |
| 10,105,559 | B2 * | 10/2018 | Daniels | F24F 11/0001 | |
| 10,280,611 | B1 * | 5/2019 | Robinson | E04B 1/6812 | |
| 10,323,856 | B2 * | 6/2019 | King, Jr. | F24F 13/08 | |
| 10,363,443 | B2 * | 7/2019 | King, Jr. | E04B 1/947 | |
| 2004/0069506 | A1 | 4/2004 | Loar | | |
| 2004/0216900 | A1 | 11/2004 | Bobenhausen | | |
| 2007/0251175 | A1 | 11/2007 | Wexler | | |
| 2009/0049781 | A1 | 2/2009 | Pilz et al. | | |
| 2009/0260303 | A1 | 10/2009 | Jensen | | |
| 2009/0286463 | A1 * | 11/2009 | Daniels | F24F 11/0001 | 454/366 |
| 2011/0061318 | A1 * | 3/2011 | August | A62C 2/06 | 52/202 |
| 2015/0047860 | A1 | 2/2015 | Rutherford | | |
| 2015/0223556 | A1 * | 8/2015 | Audet | A62B 17/003 | 36/3 R |

FOREIGN PATENT DOCUMENTS

| | | | | |
|---|---|---|---|---|
| EP | 1684026 | A1 * | 7/2006 | |
| GB | 1529733 | A * | 10/1978 | E06B 5/164 |
| GB | 2182557 | A * | 5/1987 | A62C 2/06 |
| GB | 2312842 | A * | 11/1997 | A62C 2/18 |
| GB | 2361868 | A * | 7/2001 | |
| WO | WO2009088393 | A2 | 7/2009 | |

* cited by examiner

VENT STRUCTURE

This application is based upon and claims priority to U.S. Provisional Application Ser. No. 62/366,520, filed Jul. 25, 2016. All extrinsic materials identified herein are incorporated by reference in their entirety.

FIELD OF THE INVENTION

The field of the invention is vent structures for use in homes and commercial buildings, and more specifically, vent structures that prevent the ingress of flames.

BACKGROUND

The background description includes information that may be useful in understanding the present invention. It is not an admission that any of the information provided herein is prior art or relevant to the presently claimed invention, or that any publication specifically or implicitly referenced is prior art.

Buildings are provided with vents in order to improve air circulation, reduce heat buildup, and reduce interior humidity. Conventional air vents allow the free movement of air in and out of enclosed structures, but typically will not stop the penetration of liquids or solids from getting through vent openings. Consequently, such vents can provide access to flames, embers, and hot gases produced by external fires to the interior of the building. Since this can lead to ignition of the building and/or its contents, it is desirable to utilize vents and similar devices that are designed to block or otherwise reduce the ability of flames and/or hot gases to traverse the vent and gain access to the interior of the building.

Various attempts have been made to provide materials and/or devices that permit airflow to building interiors under normal conditions and prevent undesirable entry of flames and/or hot gases when a fire is present outside of the building. United States Patent Publication No. 2009/0049781, to Pilz et al, describes wall systems and construction components that incorporate intumescent materials, which expand when heated. Pilz et al teaches that such materials can be incorporated into a vent as a perforated layer that lies within the vent structure such that air flow through the perforations (and hence the vent) under normal conditions. This perforated intumescent layer expands when heated to block flow across the vent. All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Similarly, United States Patent Application No. 2004/0216900, to Bobenhausen, describes a system for preventing the spread of fire that has started in an enclosed space (in this instance, an aircraft interior) by placing intumescent materials in and/or around apertures and other openings that surround the enclosed space. Expansion of the intumescent material by heat restricts or eliminates flow of materials through such openings. Furthermore, United States Patent Application No. 2007/0251175, to Wexler, describes a louvered vent system in which intumescent material is affixed to a louver surface such that expansion on heating causes the material to contact an adjacent louver, thereby reducing or blocking airflow through the vent.

All of these designs, however, appear to be arranged such that, when flames or superheated air enter the structure, the intumescent material is immediately and directly exposed. Since such intumescent material requires time for expansion, this direct exposure can permit superheated air, flames, and/or flaming materials to bypass the intumescent material before it is fully expanded, permitting undesirable entry of such materials into the space to be protected.

Thus, there is still a need for a safe, effective, and economical means for preventing flames, superheated air, and/or flaming materials from an external fire from entering a ventilated building or structure.

SUMMARY OF THE INVENTION

The inventive subject matter provides apparatus, systems, and methods in which a vent structure effectively prevents flames, superheated air, and/or flaming materials (e.g., embers) from an external fire from entering a building or structure. In one aspect, a vent apparatus comprises a frame that defines an inlet side, an outlet side, and an internal passage. An inlet is disposed on the inlet side, and an outlet disposed on the outlet side. The internal passage extends between the inlet and the outlet. A blocking member having an intumescent material is disposed on a surface of the guiding member that faces the outlet side. Furthermore, the blocking member has a non-expanded state that allows flow of material and an expanded state that at least partially blocks the flow of material between the inlet and outlet.

It should be appreciated that the guiding member can be thermally coupled with the blocking member to thereby transfer heat received from the flow of material to the blocking member. The flow of material can be at least one of heated air, flames, and burning debris (e.g., embers). Advantageously, the blocking member can heat and expand through heat exchange with the guiding member prior to being directly exposed to the at least one of heated air, flames, and burning debris entering the inlet from an external fire. Thus, the blocking member will be partially, or completely, expanded to block at least one of heated air, flames, and burning debris from entering into the structure or building.

The blocking member can be an intumescent tape (e.g., 3M™ Expantrol™ Fire Barrier Flexible Intumescent Strip or other commercially available intumescent tapes) or a block of intumescent material. As discussed above, it is contemplated that the blocking member at least partially blocks the flow of material between the inlet and outlet. In some embodiments, a second blocking member having an intumescent material can be disposed on the guiding member. It is contemplated that the blocking member and the second blocking member are configured to collectively block the flow of material between the inlet and the outlet when in the expanded state. A grid can extend across the outlet as an additional safety measure against external materials (e.g., embers, debris, etc.) from entering the structure or building.

Preferably, the internal passage between the inlet and outlet is non-linear. For example, a first leg member can extend from a surface on the inlet side toward the outlet side, and a second leg member extends from a guiding member in the internal passage toward the inlet side, such that the first leg member and the second leg member direct the flow of material that enters the inlet to make a 180 degree angle turn. The second leg member can be perpendicular to a portion of the guiding member to thereby direct the flow of material that enters the inlet to make a 90 degree angle turn. It should be appreciated that the non-linear passage further reduces the risk that at least one of heated air, flames, and burning debris from an external fire enters the building or structure through the vent.

In another aspect, a vent apparatus having a frame that defines an inlet side, an outlet side, and an internal passage that extends between the inlet side and the outlet side is contemplated. An inlet disposed on the inlet side and an outlet disposed on the outlet side. A guiding member is disposed in the internal passage, such that the guiding member directs a flow of material that enters the inlet towards the inlet side. A blocking material having an intumescent material is disposed on the guiding member to thereby (i) allow the flow of material between the inlet and the outlet when in a non-expanded state, and (ii) at least partially block the flow of material between the inlet and the outlet when in an expanded state.

It should be appreciated that the guiding member is typically thermally coupled with the blocking member to thereby transfer heat received from the flow of material to the blocking member. Similar to the aspect above, the flow of material is at least one of heated air, flames, and burning debris (e.g., embers). Advantageously, the blocking member can heat and expand through heat exchange with the guiding member prior to being exposed to the at least one of heated air, flames, and burning debris entering the inlet from an external fire.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The inventors have discovered an effective and economical vent structure that prevents the ingress of flames, superheated air, and/or burning debris (e.g., embers) from an external fire into a structure or building. The vent structure comprises a guiding member that deflects or directs a flow of material (e.g., flames, superheated air, and/or burning debris) entering an inlet in a non-linear passage before reaching an outlet that outputs into the interior of a building or structure. A blocking member having an intumescent material is typically disposed on a surface of the guiding member that faces the outlet. Heat from the flow of material is received by the guiding member as the flow of material is deflected or directed within an internal passage of the vent. The heat is transferred to a blocking member to thereby expand the blocking member and at least partially block the flow of material from reaching the outlet.

Figure 1A:
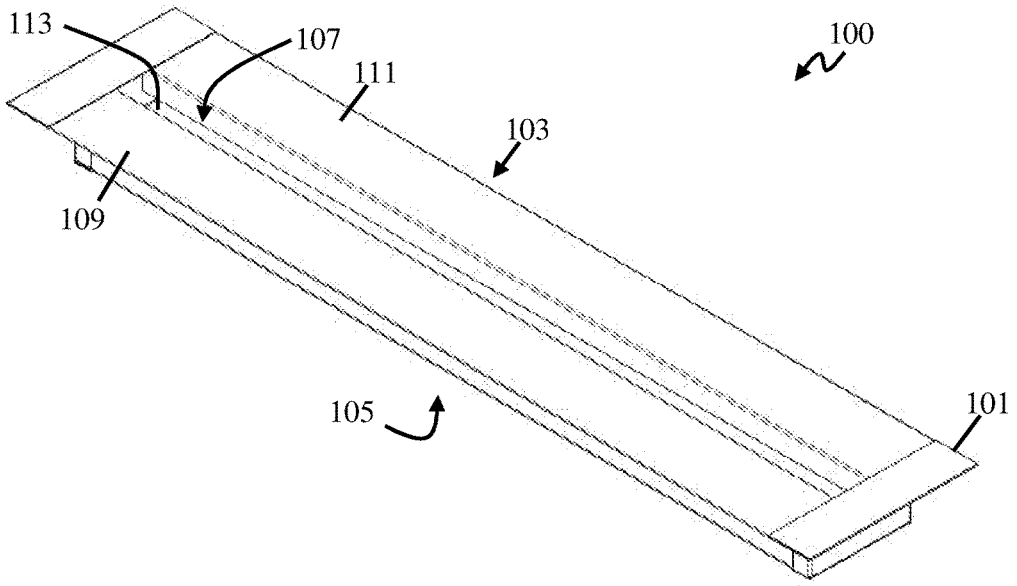
FIG. 1A is a perspective view of an embodiment of a vent.

FIG. 1A shows an embodiment of a vent structure 100. Vent structure 100 can be incorporated into a building or structure in many different configurations. For example, vent structure 100 can be incorporated into a building or structure as an under eave or soffit vent. Vent structure 100 comprises a frame 101 that defines an inlet side 103, an outlet side 105, and an internal passage (showed in more detail below) that extends between inlet side 103 and outlet side 105.

Figure 1B:
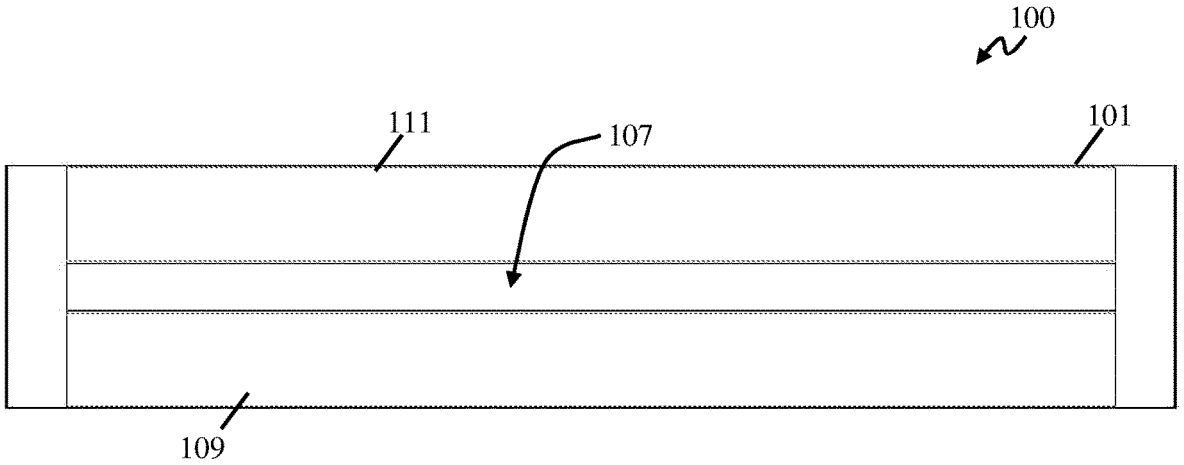
FIG. 1B is a front view of the vent of FIG. 1A showing the inlet side.

An inlet 107 is disposed on inlet side 103, and is disposed between a first surface 109 and a second surface 111 on inlet side 103 as also shown in FIG. 1B. It is contemplated that inlet side 103 is exposed to the exterior of the building or structure on which vent structure 100 is incorporated. Within vent structure 100 is a guiding member 113 that can direct or deflect a flow of material that enters inlet 107. Under fire conditions, the flow of materials can be at least one of heated air, flames, and burning debris (e.g., embers). Under normal conditions, the flow of material can be ambient air.

Figure 1C:
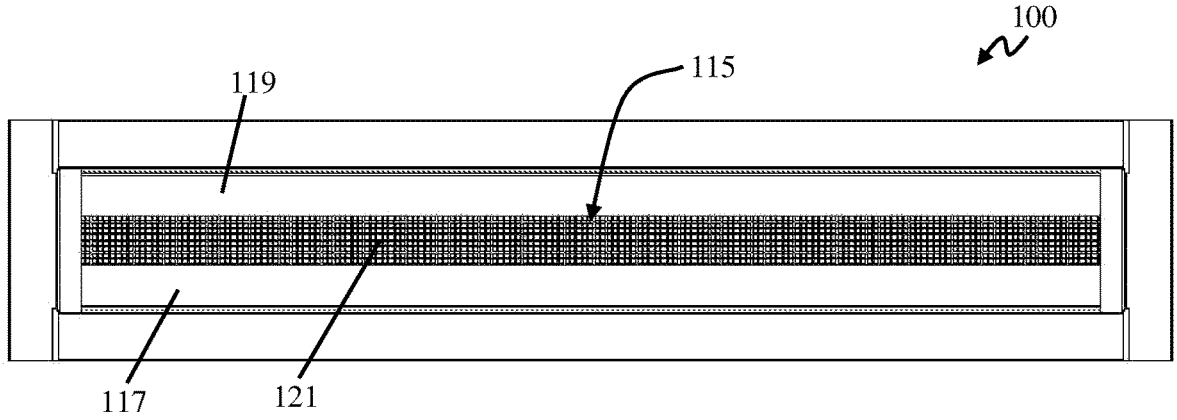
FIG. 1C is a back view of the vent of FIG. 1A showing the outlet side.
Figure 1D:
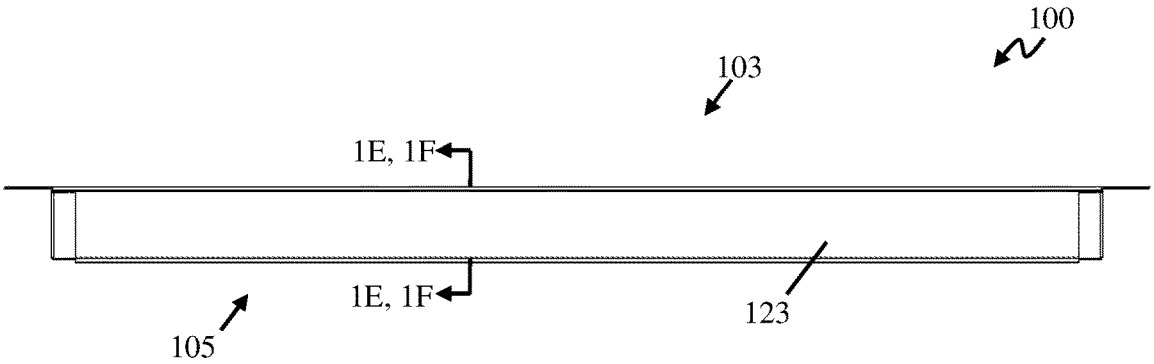
FIG. 1D is a side view of the vent of FIG. 1A.

FIG. 1C shows outlet side 105 of vent structure 100. An outlet 115 is disposed between a first surface 117 and a second surface 119 on outlet side 105. A grid 121 covers outlet 115 to prevent debris and other materials from entering the building or structure on which vent structure 100 is incorporated. Typically, grid 121 is coupled to first surface 117 and second surface 119 of outlet side 103. It is contemplated that outlet side 115 is disposed in the interior of the building or structure. The side view shown in FIG. 1D shows that inlet side 103 and outlet side 105 are disposed on opposite ends of vent structure 100. A sidewall 123 of vent structure 100 extends between inlet side 103 and outlet side 105.

Figure 1E:
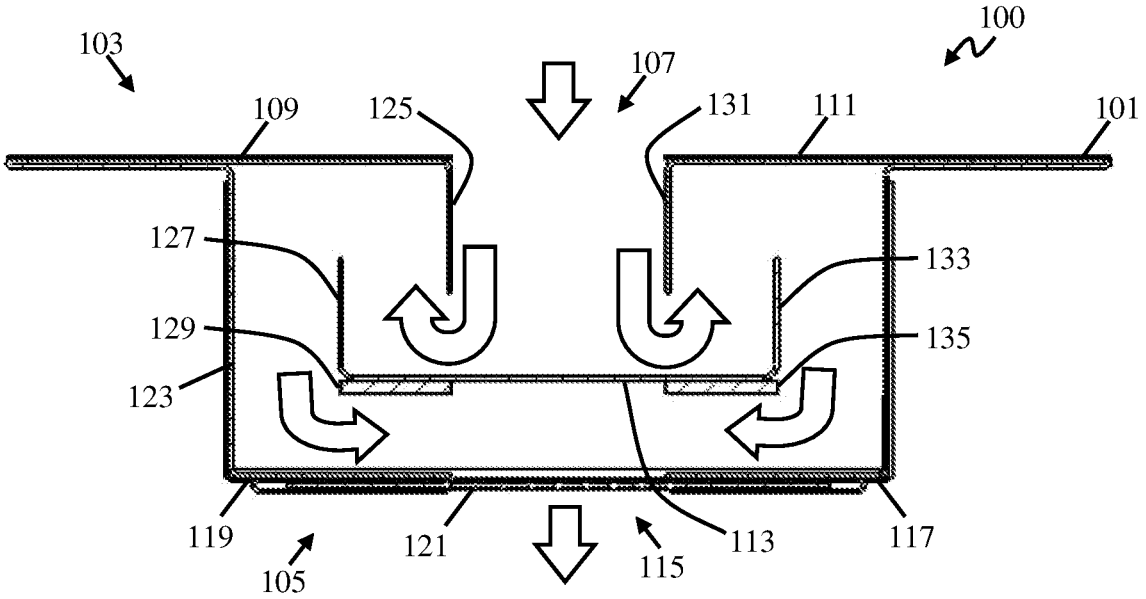
FIG. 1E is a cross-sectional view of the vent of FIG. 1A showing blocking members in a non-expanded state.

Guiding member 113 is disposed within the internal passage of vent structure 100 as shown in FIG. 1E. Guiding member 113 comprises a first surface that faces inlet side 103 and a second side that faces outlet side 105. It should be appreciated that the first surface is directly exposed to the flow of material entering inlet 107, which thereby causes guiding member 113 to heat rapidly under fire conditions. This heat can be transferred from guiding member 113 to other members (e.g., a blocking member) in the internal passage. A first leg member 125 extends from a first surface 109 on inlet side 103 toward outlet side 105. As shown in FIG. 1E, first leg member 125 and first surface 109 of inlet side 103 form a 90 degree angle. However, it is contemplated that first leg member 125 and first surface 109 of inlet side 103 can form other angles, such an angle between 30 and 150 degrees, 45 and 135 degrees, and 60 and 120 degrees.

A second leg member 127 extends from guiding member 113 towards inlet side 103. The angle formed between second leg member 127 and guiding member 113 is 90 degrees. However, other angles between second leg member 127 and guiding member 113 are contemplated, such as an angle between 30 and 150 degrees, 45 and 135 degrees, and 60 and 120 degrees. First leg member 125 and second leg member 129 can be parallel to thereby direct a flow of material entering inlet 107 toward inlet side 103 as shown in the arrows depicting an exemplary path for the flow of material. For example, a portion of the flow of material that enters inlet 107 can be deflected or directed to turn at an angle of 180 degrees to an area between first leg member 125 and second leg member 127.

First leg member 125 and second leg member 127 are optionally parallel to one another as shown in FIG. 1E. Additionally, or alternatively, first leg member 125 extends from an end of first surface 109 on inlet side 103 and second leg member 127 extends from an end of guiding member 113. Vent structure 100 can further comprise a third leg member 131 that extends from second surface 111 on inlet side 103 towards outlet side 105, and a fourth leg member 133 that extends from guiding member 113 towards inlet side 103. It is contemplated that at least two of first leg member 125, second leg member 127, third leg member 131 and fourth leg member 133 are parallel to one another. Third leg member 131 and fourth leg member 133 can collectively deflect or direct a portion of the flow of material that enters inlet 107 to turn at an angle of 180 degrees to an area between third leg 131 and fourth leg 133.

It should be appreciated that guiding member 113 can be thermally coupled with a first blocking member 129 having intumescent material. For example, guiding member 113 can comprise a thermally conductive metal, such as aluminum, copper, tin, steel, and/or other metals or combinations thereof. Blocking member 129 has a non-expanded state (as shown in FIG. 1E) and an expanded state (as shown below), and is positioned within the internal passage (i) to allow the flow of material between inlet 107 and outlet 115 when in the non-expanded state (e.g., an exemplary flow path depicted by the arrows shown in FIG. 1E), and (ii) to at least partially block the flow of material between inlet 107 and outlet 115 when in the expanded state.

Heat received from the flow of material under fire conditions received by guiding member 113 can be transferred to blocking member 129 to thereby cause a transition from the non-expanded state to the expanded state when a pre-determined temperature is reached. For example, the blocking member can begin to expand when a temperature between 150° C. (302° F.) and 250° C. (482° F.) is reached and the rate of expansion can optionally increase once 350° C. (662° F.) is reached. In another example, expansion of blocking member 129 from the non-expanded to the expanded state can occur at 200° C. (392° F.) and the rate of expansion can increase after 280° C. (536° F.) is reached.

It should be appreciated that the heat necessary to cause the transition from the non-expanded state to the expanded state can be supplied (i) solely by the heat transferred by guiding member 113 or (ii) by a combination of heat transferred by guiding member and heat directly received from the flow of material as it contacts blocking member 129 when passing between inlet 107 and outlet 115. Thus, in some instances, the rate at which blocking member 129 transitions or expands from the non-expanded state to the expanded state is improved over conventional vents due to the combined heating by (i) heat exchange with guiding member 113 and (ii) direct contact with the flow of material. As described above, the flow of material under fire conditions can be at least one of heated air, flames, and burning debris while the flow of material under normal conditions can be ambient air.

Blocking member 129 can be an intumescent tape (e.g., 3M™ Expantrol™ Fire Barrier Flexible Intumescent Strip or other commercially available intumescent tapes) a block of intumescent material. Typically, blocking member 129 is disposed on a surface of guiding member 113 that faces outlet side 105. It is contemplated that blocking member 129 extends along the length of guiding member to block the flow of material between inlet and outlet when in an expanded state. When in the non-expanded state, blocking member 129 allows the flow of material (e.g., ambient air in normal conditions) between inlet 107 and outlet 115. In such non-expanded state, it is contemplated that the flow of material comprises ambient air, or heated air and/or burning debris in an amount below a pre-determined temperature that causes the transition from the non-expanded to the expanded state. One exemplary flow path is depicted by the arrows in FIG. 1E showing the flow of material entering inlet 107, then deflected by guiding member 113 toward inlet side 103 by a 180 degree turn to an area between first leg member 125 and second leg member 127, then directed toward outlet side by another 180 degree turn to an area between second leg member 127 and sidewall 123, then directed toward outlet 115 by a 90 degree turn to an area between blocking member 129 and second surface 119 on outlet side 105.

A second blocking member 135 can be disposed on guiding member 113 as shown in FIG. 1E. It is contemplated that second blocking member 135 also comprises an intumescent material, and is positioned within the internal passage (i) to allow the flow of material between the inlet and the outlet when in the non-expanded state, and (ii) to at least partially block the flow of material between the inlet and the outlet when in the expanded state. A second exemplary flow path is depicted by the arrows in FIG. 1E showing the flow of material entering inlet 107, then deflected by guiding member 113 toward inlet side 103 by a 180 degree turn to an area between third leg member 131 and fourth leg member 133, then directed toward outlet side by another 180 degree turn to an area between fourth leg member 133 and sidewall 123, then directed toward outlet 115 by a 90 degree turn to an area between second blocking member 135 and first surface 117 on outlet side 105.

Figure 1F:
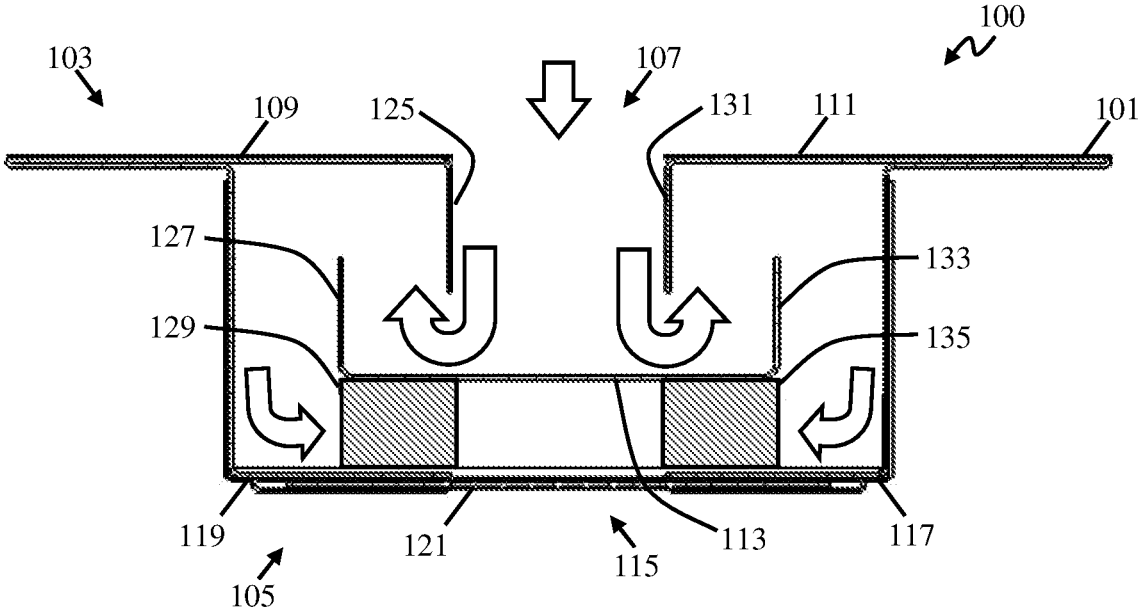
FIG. 1F is a cross-sectional view of the vent of FIG. 1A showing blocking members in an expanded state.

It should be appreciated that the non-linear path between inlet 107 and outlet 115 further reduces the risk that harmful materials, such as burned debris, will enter a structure or building. It is contemplated that blocking member 129 and/or second blocking member 135 transition from a non-expanded state to an expanded state after a pre-determined temperature is reached. FIG. 1F shows blocking member 129 and second blocking member 135 in an expanded state to thereby block the flow of materials between inlet 107 and outlet 115. Thus, at least one of heated air, flames, and burning debris are prevented from entering the structure or building on which vent structure 100 is incorporated. In other embodiments, it is contemplated that at least one of blocking member 129 and second blocking member 135 only partially block the flow of material between inlet 107 and outlet 115.

Figure 2A:
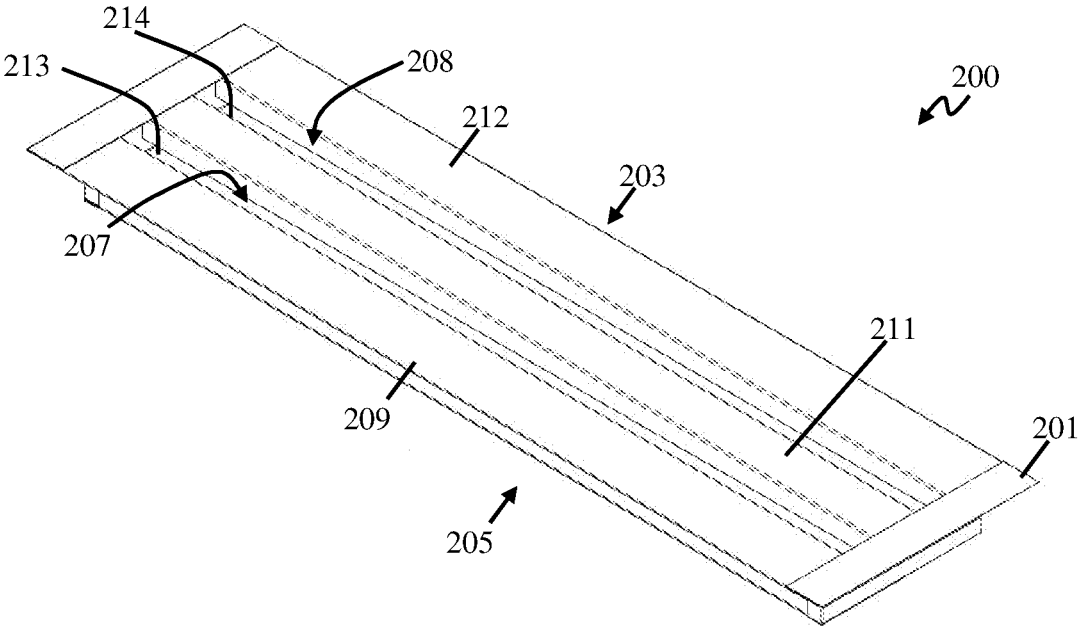
FIG. 2A is a perspective view of an embodiment of a vent.

FIG. 2A shows another embodiment of a vent structure 200. Similar to the vent structure discussed above, vent structure can be incorporated into a building or structure in many different configurations (e.g., as an under eave or soffit vent). Vent structure 200 comprises a frame 201 that defines an inlet side 203 and an outlet side 205. A first inlet 207 and a second inlet 208 are disposed on inlet side 203. Typically, inlet side 203 is exposed to the exterior of the building or structure on which vent structure 200 is incorporated.

Figure 2B:
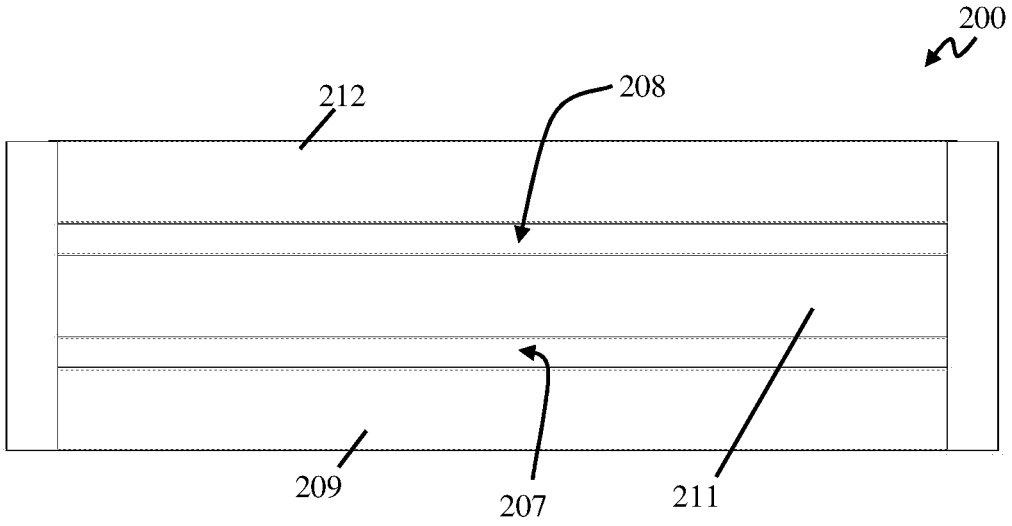
FIG. 2B is a front view of the vent of FIG. 2A showing the inlet side.

First inlet 207 is disposed between a first surface 209 and a second surface 211 on inlet side 203. Second inlet 208 is disposed between second surface 211 and a third surface 212 on inlet side 203 as shown in FIG. 2B. Within vent structure 200 is a first guiding member 213 and a second guiding member 214 that each can direct or deflect a flow of material that enters inlet 207 and second inlet 208.

Figure 2C:
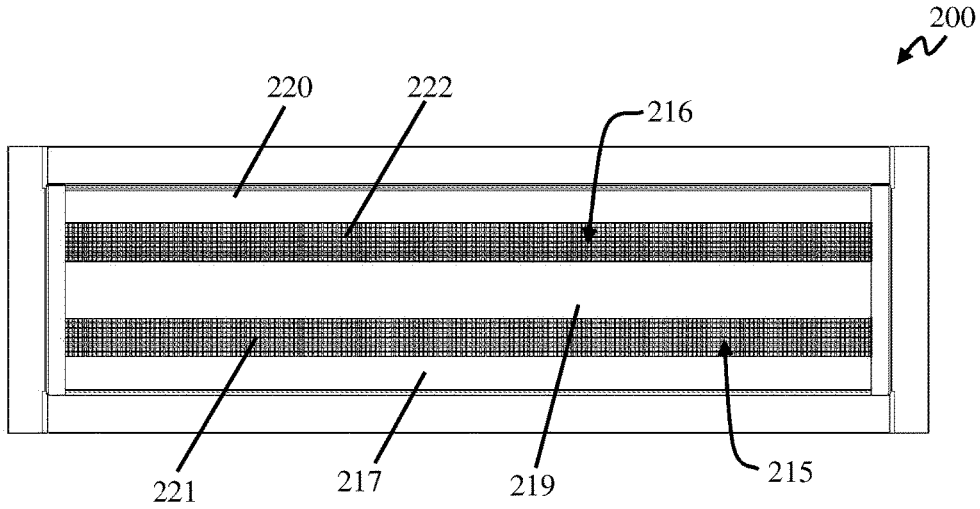
FIG. 2C is a back view of the vent of FIG. 2A showing the outlet side.
Figure 2D:
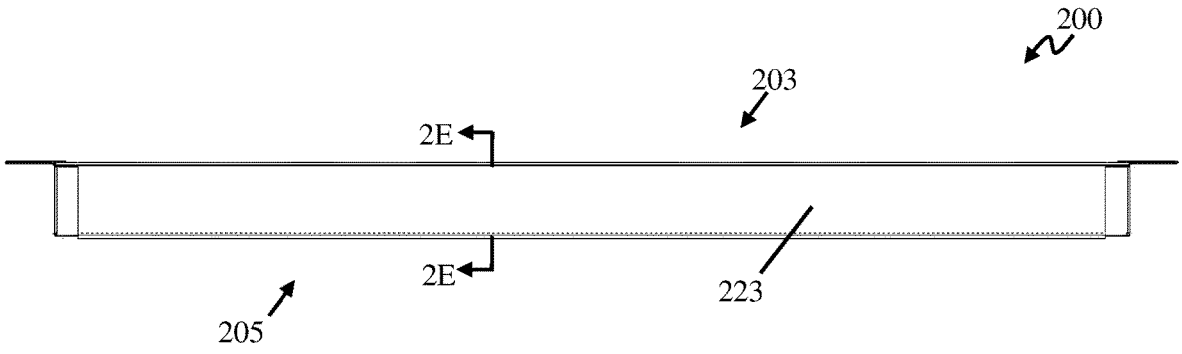
FIG. 2D is a side view of the vent of FIG. 2A.

Outlet side 205 is shown in more detail in FIG. 2C. A first outlet 215 is disposed between a first surface 217 and a second surface 219 on outlet side 205, and a second outlet 216 is disposed between second surface 219 and a third surface 220 on outlet side 205. Outlet side 205 is typically disposed in the interior of the building or structure on which vent structure 200 is incorporated. To further prevent burning debris or other harmful from entering the building or structure, a first grid 221 and a second grid 222 cover first outlet 215 and second outlet 216, respectively. As shown in FIG. 2D, inlet side 203 and outlet side 205 are disposed on opposite ends of vent structure 200. A sidewall 223 extends between inlet side 203 and outlet side 205.

Figure 2E:
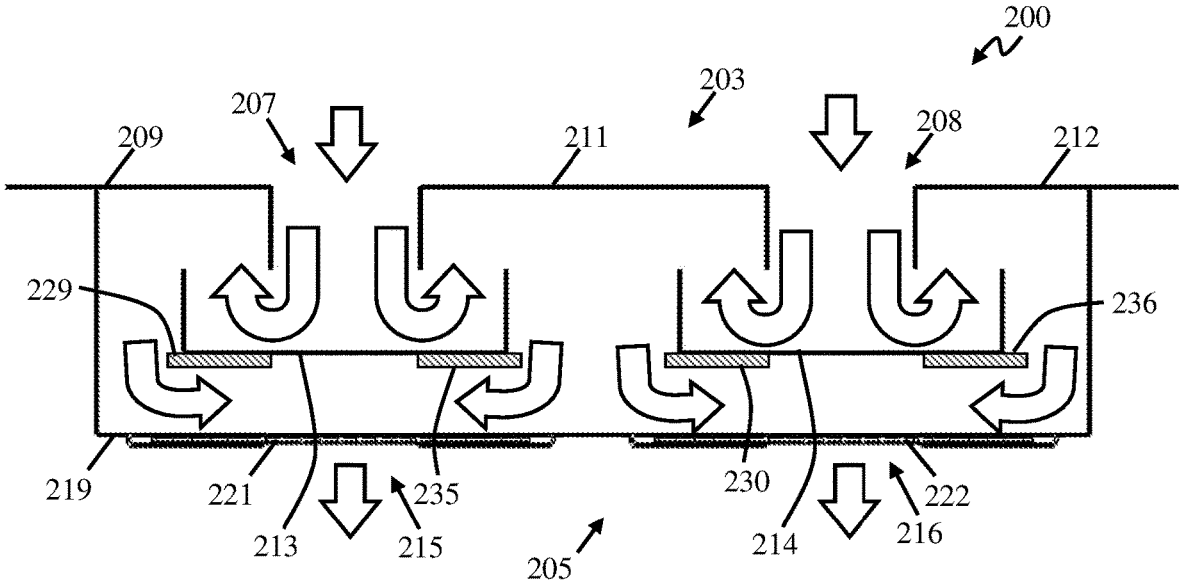
FIG. 2E is a cross-sectional view of the vent of FIG. 2A showing blocking members in a non-expanded state.

First guiding member 213 and Second guiding member 214 are disposed in internal passage of vent structure 200 as shown in detail in FIG. 2E. First guiding member 213 and second guiding member 214 have the same structure as guiding member 113 described above. A first blocking member 229 and a second blocking member 235 can be disposed on a surface of first guiding member 213 that faces outlet side 205. First blocking member 229 and second blocking member 235 comprise an intumescent material, and are positioned within the internal passage (i) to allow the flow of material between first inlet 207 and first outlet 215 when in the non-expanded state (e.g., an exemplary flow path depicted by the arrows shown in FIG. 2E), and (ii) to at least partially block the flow of material between first inlet 207 and first outlet 215 when in the expanded state.

Additionally, or alternatively, a third blocking member 230 and a fourth blocking member 236 are disposed on a surface of second guiding member 214 that faces outlet side 205. Third blocking member 230 and fourth blocking member 236 can comprise an intumescent material, and are positioned within the internal passage (i) to allow the flow of material between second inlet 208 and second outlet 216 when in the non-expanded state (e.g., an exemplary flow path depicted by the arrows shown in FIG. 2E), and (ii) to at least partially block the flow of material between second inlet 208 and second outlet 216 when in the expanded state.

First guiding member 213 is thermally coupled with first blocking member 229 and second blocking member 235 to thereby transfer heat content. Similarly, second guiding member 214 is thermally coupled with third blocking member 230 and fourth blocking member 236 to thereby transfer heat content. It is contemplated that the heat required to transition at least one of first blocking member 229, second blocking member 235, third blocking member 230, and fourth blocking member 236 is supplied (i) solely by heat transfer with first guiding member 213 and/or second guiding member 214, or (ii) by a combination of heat transferred by first guiding member 213 and/or second guiding member 214, and heat directly received by the flow of material as it contacts the blocking member. As described above, the flow of material can be at least one of heated air, flames, and burning debris under fire conditions, and ambient air under normal conditions.

It should be appreciated that the non-linear path provided throughout the internal passage of vent structure 200 further reduces the risk that harmful materials, such as burned debris, will enter a structure or building. Under normal circumstances exterior air can freely enter vent structure 200 and travel to first outlet 215 and second outlet 216. However, under fire conditions, flames, superheated air and/or burned debris contacts first guiding member 213 and second guiding member 214, and causes the expansion of the various blocking members to restrict access to first outlet 215 and second outlet 216.

One should appreciate that the disclosed techniques provide many advantageous technical effects including providing an improved degree of protection to building interiors from external fires, using a device that is readily retrofitted to existing structures. Additionally, it is contemplated that a blocking member can be disposed on vents having other cross-sectional areas. For example, a blocking member can be disposed on air guide members of the vent disclosed in U.S. Pat. No. 8,684,803, which is hereby incorporated by reference.

It is contemplated that contemplated vent structures can have various dimensions as deemed appropriate for its particular application. For example, contemplated vents can have a size similar to under eave or soffit vents, such as a vent having a length and width of 22 inches by 3½ inches, 14 inches by 3½ inches, 120 inches by 3 inches, 120 inches by 2 inches, 22 inches by 5½ inches, 120 inches by 5½ inches, and so forth.

Additionally, or alternatively, contemplated blocking members can transition irreversibly from a non-expanded state to an expanded state. In such embodiments, the blocking member can simply be replaced once it transitions to the expanded state. In other embodiments, the blocking member can reversibly transition between the non-expanded state and the expanded state. For example, the blocking member can expand when exposed to a pre-determined temperature, and contract to its original, non-expanded state when below the pre-determined temperature.

Devices of the inventive concept can be incorporated into vent structures for use during initial construction, or alternatively be incorporated into devices that can be readily integrated into an existing ventilation system. For example, a device of the inventive concept can be configured to lie within a ventilation passage that is in fluid communication with an existing vent. In some embodiments such a device can be positioned proximal to an existing vent. In other embodiments such a device can be positioned at a distance from an existing vent, provided that the intervening passage is flame and/or heat resistant.

Applicants note that examples of devices of the inventive concept have been successfully tested. For example, testing was performed in accordance with section 9 of ASTM E2886/E2886M-14 (Standard Test Method for Evaluating the Ability of Exterior Vents to Resist the Entry of Embers and Direct Flame Impingement) on samples similar to the embodiment disclosed in FIG. 1A-1E. Results showed that the samples tested showed no signs of ember intrusion due to non-ignition or charring of a cotton pad on an outlet side of the samples.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A vent apparatus, comprising:

a frame that defines an inlet side, an outlet side, and an internal passage;

an inlet disposed on the inlet side, and an outlet disposed on the outlet side, wherein the internal passage is disposed between the inlet and the outlet, wherein the inlet is defined by at least a first surface of the inlet side that extends from one of the side walls to the inlet, and wherein the outlet is defined by at least a first surface of the outlet side that extends from one of the side walls to the outlet;

a guiding member disposed in the internal passage to direct a flow of material entering the vent apparatus through the inlet, and wherein the guiding member comprises a first surface that faces the inlet side and a second surface that faces the outlet side;

a blocking member disposed on a portion of the second surface of the guiding member that faces the first surface of the outlet side, wherein the blocking member comprises an intumescent material; and wherein the blocking member has a non-expanded state and an expanded state, and is positioned within the internal passage (i) to allow the flow of material between the inlet and the outlet, including between the portion of the second surface of the guiding member comprising the blocking member and the first surface of the outlet side when in the non-expanded state, and (ii) to block the flow of material between the portion of the blocking member comprising the blocking member and the first surface of the outlet side when in the expanded state.

2. The apparatus of claim 1, wherein the guiding member is thermally coupled with the blocking member to thereby transfer heat received from the flow of material to the blocking member.

3. The apparatus of claim 2, wherein the flow of material is at least one of heated air, flames, and burning debris.

4. The apparatus of claim 1, wherein the intumescent material is an intumescent tape.

5. The apparatus of claim 1, further comprising a first leg member that extends from the inlet side toward the outlet side, and a second leg member that extends from the guiding member towards the inlet side.

6. The apparatus of claim 5, wherein the first leg member is parallel to the second leg member.

7. The apparatus of claim 5, further comprising a third leg member that extends from the inlet side toward the outlet side, and a fourth leg member that extends from the guiding member to the inlet side.

8. The apparatus of claim 7, wherein at least two of the first leg member, second leg member, third leg member, and fourth leg member are parallel.

9. The apparatus of claim 1, further comprising a grid that extends across the outlet.

10. The apparatus of claim 1, further comprising a second blocking member disposed on the second surface of the guiding member, wherein the second blocking member comprises an intumescent material.

11. The apparatus of claim 10, wherein the second blocking member has a non-expanded state and an expanded state, and is positioned within the internal passage (i) to allow the flow of material between the inlet and the outlet when in the non-expanded state, and (ii) to block the flow of material between the inlet and the outlet when in the expanded state.

12. The apparatus of claim 11, wherein the blocking member and the second blocking member are configured to collectively block the flow of material between the inlet and the outlet when in the expanded state.

13. A vent apparatus, comprising:

a frame that defines an inlet side, an outlet side, side walls between the inlet side and the outlet side, and an internal passage that extends between the inlet side and the outlet side;

an inlet disposed on the inlet side and an outlet disposed on the outlet side, wherein the inlet is defined by at least a first surface of the inlet side that extends from one of the side walls to the inlet, and wherein the outlet is defined by at least a first surface of the outlet side that extends from one of the side walls to the outlet;

a guiding member disposed in the internal passage, wherein the guiding member directs a flow of material that enters the inlet towards the inlet side;

a blocking member disposed on a portion of the guiding member facing the first surface of the outlet side, wherein the blocking member comprises an intumescent material;

wherein the blocking member has a non-expanded state and an expanded state, and is positioned within the internal passage (i) to allow the flow of material between the inlet and the outlet, including between the portion of the guiding member comprising the blocking member and the first surface of the outlet side when in the non-expanded state, and (ii) to block the flow of material between the portion of the guiding member comprising the blocking member and the first surface of the outlet side when in the expanded state;

wherein the guiding member is thermally coupled with the blocking member to thereby transfer heat received from the flow of material to the blocking member; and wherein heat from the flow of material is received by the guiding member as the flow of material is deflected or directed within the internal passage of the vent apparatus and the heat is transferred to the blocking member to thereby expand the blocking member and block the flow of material between the blocking member and the first surface of the outlet side.

14. The apparatus of claim 13, wherein the flow of material is at least one of heated air, flames, and burning debris.

15. The apparatus of claim 13, wherein the blocking member is disposed on a surface of the guiding member that faces the outlet side.

16. The apparatus of claim 13, wherein the intumescent material is an intumescent tape.

17. The apparatus of claim 13, further comprising a first leg member that extends from a surface on the inlet side toward the outlet side, and a second leg member that extends from the guiding member towards the inlet side.

18. The apparatus of claim 17, wherein at least one of (i) the second leg member is perpendicular to a portion of the guiding member to thereby direct the flow of material that enters the inlet to make a 90 degree angle turn, and (ii) the first leg member and the second leg member are parallel to thereby direct the flow of material that enters the inlet to make a 180 degree angle turn.

* * * * *